US005971794A

United States Patent [19]

Holzle

[11] Patent Number: 5,971,794

[45] Date of Patent: Oct. 26, 1999

[54] CONNECTOR, IN PARTICULAR FOR RIBBON CABLES

[75] Inventor: Dieter Holzle, Deckenpfronn, Germany

[73] Assignee: Dieter Holzle Technik-Projekte GmbH, Deckenpfronn, Germany

[21] Appl. No.: 09/162,365

[22] Filed: Sep. 29, 1998

[30] Foreign Application Priority Data

Oct. 10, 1997 [DE] Germany ..... 197 44 754

[51] Int. Cl.[6] ..... H01R 4/24

[52] U.S. Cl. ..... 439/405

[58] Field of Search ..... 439/404, 405, 439/638

[56] References Cited

U.S. PATENT DOCUMENTS

| | | | |
|---|---|---|---|
| 3,912,354 | 10/1975 | Campell et al. | 439/404 |
| 4,367,004 | 1/1983 | Fujiura et al. | 439/404 |
| 4,396,837 | 8/1983 | Crouse . | |
| 4,533,198 | 8/1985 | Anhalt | 439/404 |
| 4,701,139 | 10/1987 | Good . | |
| 4,758,536 | 7/1988 | Miller . | |
| 5,376,018 | 12/1994 | Davis et al. | 439/404 |

FOREIGN PATENT DOCUMENTS

| | | |
|---|---|---|
| 241 755 | 1/1988 | European Pat. Off. . |
| 2355774 | 5/1974 | Germany . |

*Primary Examiner*—Neil Abrams
*Assistant Examiner*—J. F. Duverne
*Attorney, Agent, or Firm*—Pillsbury Madison & Sutro

[57] ABSTRACT

A connector for a cable, the cable having a plurality of insulated conductors enclosed by insulation, the connector including: a first connector element having a plurality of recesses, and a second connector element constructed to be joined to the first connector element to delimit a region for receiving the insulated conductor end sections, with the recesses opening into the region; a plurality of blade terminals carried by the second connector element and each having two blades, the blade terminals being oriented to extend across the region so that the two blades of each of the blade terminals extend into a respective one of the recesses, and a respective conductor end section is gripped between the two blades of a respective one of the blade terminals in order to conductively contact the respective one of the blade terminals; a plurality of contact elements, each conductively secured to a respective one of the blade terminals, for connection to another connector; and a plurality of inserts each installed in a respective one of the recesses and each constituted by a metal enclosure that receives the blades of a respective one of the blade terminals and that is shaped and dimensioned to contact the blades and prevent spreading apart of the blades.

6 Claims, 6 Drawing Sheets

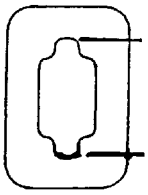
FIG. 10A
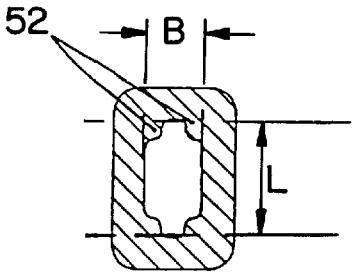
FIG. 10B
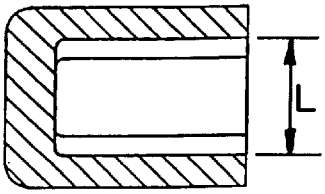
FIG. 10E
FIG. 10D
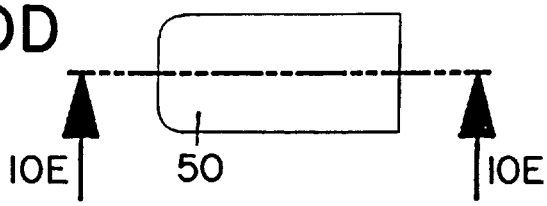
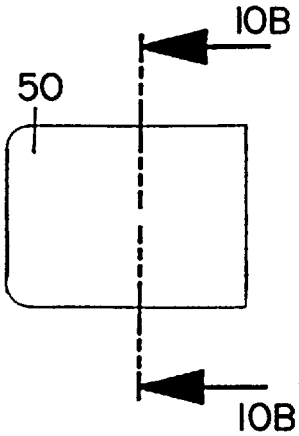
FIG. 10C

CONNECTOR, IN PARTICULAR FOR RIBBON CABLES

BACKGROUND OF THE INVENTION

The present invention relates to a plug or socket connector, in particular for ribbon cables, comprised of a plurality of insulated conductor end sections inserted and positioned in a first connector element, and a second connector element containing inward pointing blade terminals that are conductively connected to contact elements, such as plug pins or sockets, via which the connector can be coupled to another connector.

A connector of this type is disclosed in European Patent Publication EP 0 251 755 A2, for example. In addition to the two connector elements, this known connector has an intermediate element which is used to fix the conductor end sections in place in the first connector element.

The first connector element is provided with recesses which are offset relative to each other in rows a . . . d, and are intended for receiving the blades of the blade terminals of the second connector element in the sense that they provide the required reception space into which the blade terminals can enter when they execute their function when the connector elements are put together, namely that of insulating their associated conductor end sections. No function of the recesses beyond this is disclosed in the above-mentioned publication.

Other known connectors of the same type also have arm-like blade terminals. U.S. Pat. No. 4,701,139 discusses the guidance function of the walls of the recesses and German Patent DE 23 55 774 C2 discusses the use of the walls to support the blade terminals.

The disadvantage of these and the multitude of further solutions which have been proposed regarding the construction of connectors of the type mentioned lies in that, because of their necessarily small size, the blade terminals can possibly lose their clamping force, in particular in case where the small material cross sections in the area of the two legs of the blade terminals are stressed over extended periods of time, in particular by temperature changes or mechanical stresses, such as vibrations. Such is the case, for example, when using such connectors in motor vehicles. Such fatigue phenomena, in particular in the areas of large temperature fluctuations and mechanical stresses, can in the worst case lead to a deterioration of the contacting with the result of a reduction of the contact cross sections and the problems arising from this. There can even result a complete disruption of the contact which, in particular in the field of motor vehicles, then can lead to considerable malfunctions of the electrical or electronic components of the motor vehicle.

BRIEF SUMMARY OF THE INVENTION

It is therefore an object of the invention to reliably prevent changes in the contacting behavior of the blade terminals and deterioration of their functions in connectors of the type described above.

The above and other objects are attained, according to the present invention, by a connector for a cable, the cable having a plurality of insulated conductors enclosed by insulation, each conductor having an end section, the connector comprising:

a first connector element having a plurality of recesses, and a second connector element constructed to be joined to the first connector element to delimit a region for receiving the insulated conductor end sections, with the recesses opening into the region;

a plurality of blade terminals carried by the second connector element and each having two blades, the blade terminals being oriented to extend across the region so that, when the first and second connector elements are joined together the two blades of each of the blade terminals extend into a respective one of the recesses, and a respective conductor end section is gripped between the two blades of a respective one of the blade terminals in order to conductively contact the respective one of the blade terminals;

a plurality of contact elements, each conductively secured to a respective one of the blade terminals, for connection to another connector; and a plurality of inserts each installed in a respective one of the recesses and each constituted by a metal enclosure delimiting an interior space that receives the blades of a respective one of the blade terminals and that is shaped and dimensioned to contact the blades and prevent spreading apart of the blades.

The basic idea of the invention therefore lies in further developing the recesses inside of the connector element, which as a rule is made of plastic, in that a metal housing is used as an insert of sufficient hardness which prevents the two legs of the fork-shaped terminal plugs from being opened as a result of thermal or mechanical stresses. The invention allows this to be easily accomplished and makes it possible to extend the area of utilization of such connectors to thermally and mechanically highly stressed operating environments.

A first advantageous embodiment of this principle of obtaining the object provides that the metal housing is closed in the shape of a ring or embodied to be cup-shaped, which assures the required stability but, on the other hand, also makes it possible that the metal housing, which surrounds each recess and therefore is associated with each individual blade terminal contact, extends from the exterior of the first connector element in sections, for example in the manner of a terminal lug, because of which additional contacting and switching possibilities result in a simple manner.

Corresponding to the extension of the metal housing toward the exterior of the first connector element, a corresponding, for example nose-like, downward extension of the insert, i.e. towards the inserted conductors, is possible. Such extensions can then be used as tension relievers and can improve the dependability and service life of such connectors.

Preferred exemplary embodiments of a connector in accordance with the invention will be described in more detail below with reference to the following drawings.

BRIEF DESCRIPTION OF THE SEVERAL VIEWS OF THE DRAWING

FIGS. 10A, B, C, D and E are, respectively, a plan view, a plan view, a side elevational view, an end elevational view and a further cross sectional view of a preferred exemplary embodiment of a component of connectors according to the invention.

DETAILED DESCRIPTION OF THE INVENTION

Figure 1:
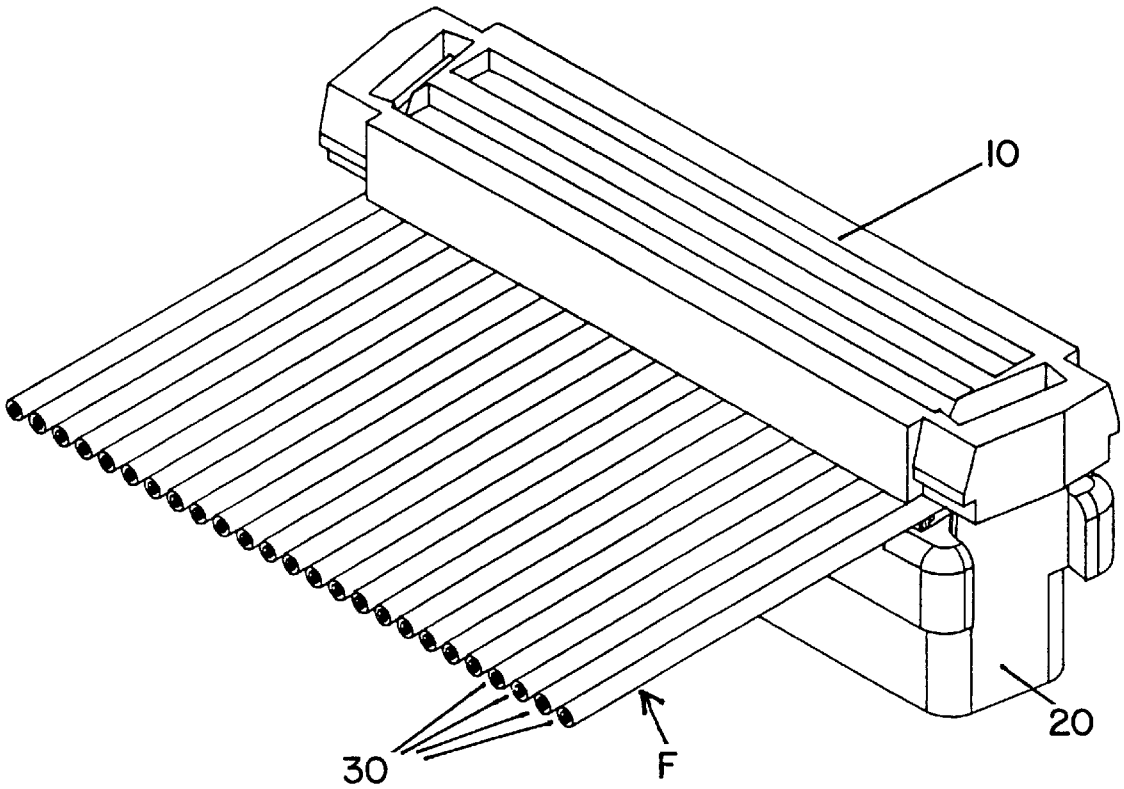
FIG. 1 is a perspective view of a first preferred exemplary embodiment of a connector in accordance with the invention.
Figure 2:
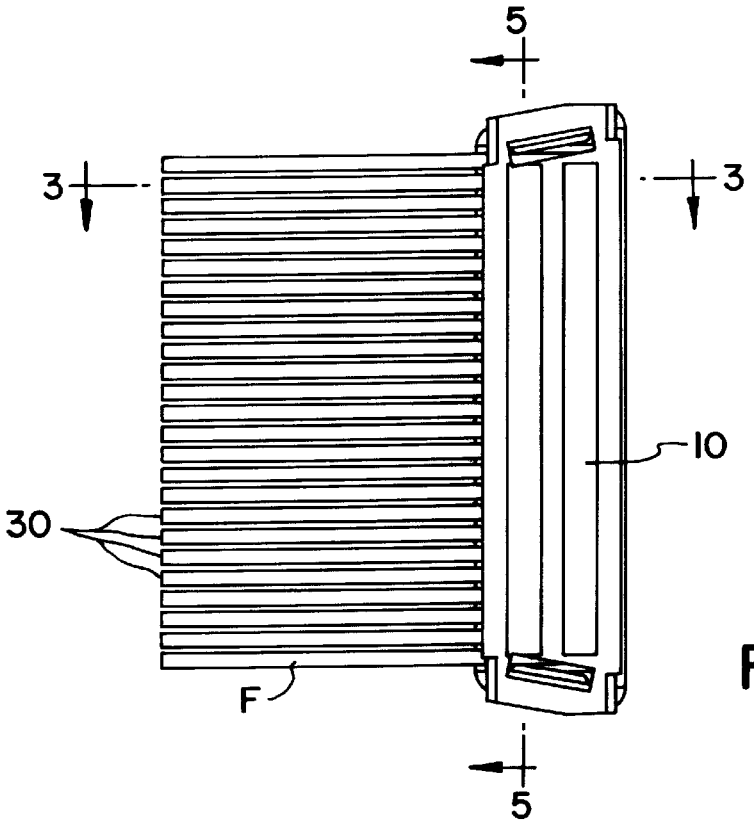
FIG. 2 is a top view of the connector of FIG. 1.

FIGS. 1 to 6 and FIG. 10 are representations of a first exemplary embodiment of the connector of the invention. As is customary, and as shown in FIG. 1, such a connector consists of a first connector element 10, into which the end of a ribbon cable F with a total of N conductors 30 has been placed and secured.

A counter-piece is constituted by a second connector element 20 which, in the position indicated, is locked together with the first connector element 10 by means of suitable catches, prongs or similar interlocking elements, so that the two connector elements 10 and 20 securely enclose the ribbon cable F between them.

Figure 3:
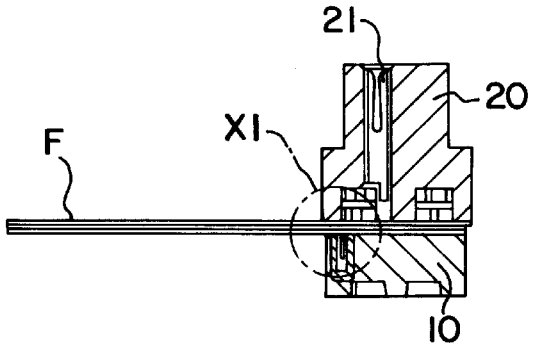
FIG. 3 is a section in the plane A—A through the connector of FIG. 2.

As shown in FIG. 3, connector element 20 of the illustrated embodiment contains female contact elements, or sockets, 21. A connector according to this embodiment is intended to be coupled with another connector having male contacts, or plugs, and which can otherwise be identical to the illustrated connector.

Figure 4:
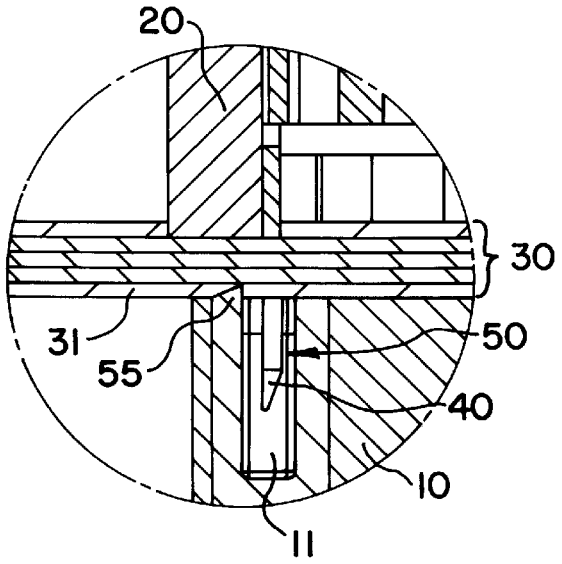
FIG. 4 is a representation of the detail X1 in FIG. 3.

Referring to FIG. 4, recesses 11 have been cut into the first connector element 10, and the second connector element 20 carries blade terminals 40 each of which projects into a respective one of recesses 11. Each blade terminal 40 has, as is known per se, a fork shape, and cuts through the insulating sheath 31 of a conductor 30 in order to make contact with its associated conductor. As is conventional in this art, these blade terminals 40 and their associated recesses 11 are arranged in two parallel rows, with the recesses 11 in one row being offset with respect to the recesses 11 in the other row. The rear ends of blade terminals 40 are connected to plug pins or sockets (not represented) in the second connector element 20, which then can accordingly be connected with a complementary matched component (socket or pin). The two connector element 10 and 20 are made in a manner known per se of plastic and therefore their structure need not be described in greater detail.

In accordance with the invention, the above-described structure is supplemented with metal housings 50 each having the form of a sleeve or cup and each inserted into a respective one of recesses 11. Each metal housing 50 receives a respective blade terminal 40 and each metal housing 50 has internal contours that are dimensioned to laterally guide the two legs 41, 42 (FIG. 6) of each blade terminal 40 and to secure those legs against spreading. The details of a preferred embodiment of such a metal housing 50 are shown in FIGS. 10A–10E, where FIG. 10B shows a cross section along line C—C of FIG. 10C and FIG. 10E is a cross section along line F—F of FIG. 10D.

The metal housing 50 shown in FIGS. 10A–10E is a cup-shaped housing with lateral walls and a bottom, enclosing an interior space whose cross section has a maximum inside length L and a maximum inside width B. At the four corner areas of the interior space, the housing walls have inwardly directed protrusions 52, so that the cross-like interior cross section has the form shown in FIG. 10B.

In this case the maximum inside length L essentially corresponds to the related exterior dimension between the outer edges of the two legs 41 and 42, so that the spreading apart of the legs 41, 42 is impossible, even under the mechanical and thermal stresses mentioned, because of the rigid structure of the metal housing 50. Even under these circumstances, the conductors 30 with their insulating sheath 31 are held securely in their position by the blade terminal 40, and contact integrity is assured. In the illustrated device, each conductor 30 has three strands.

Figure 5:
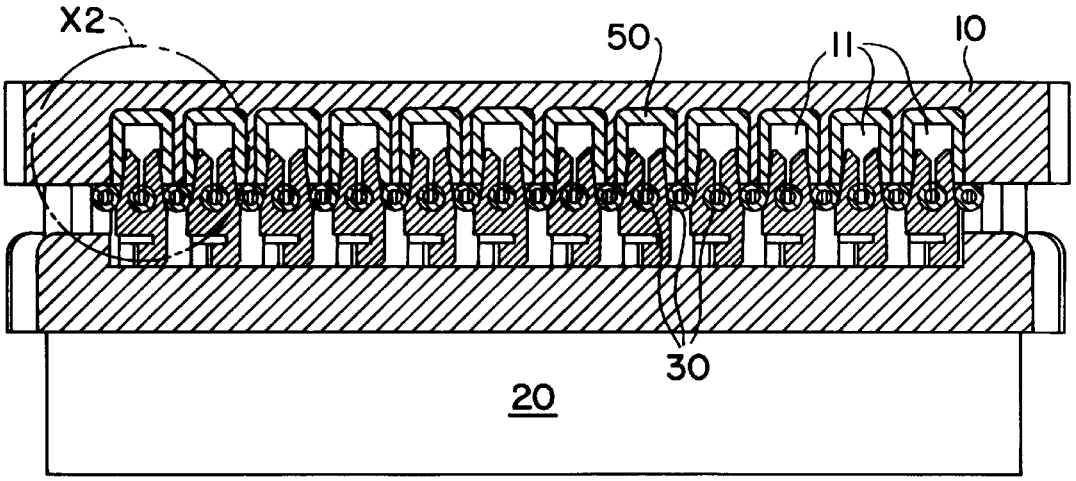
FIG. 5 is a section in the plane B—B through the connector of FIG. 2.
Figure 6:
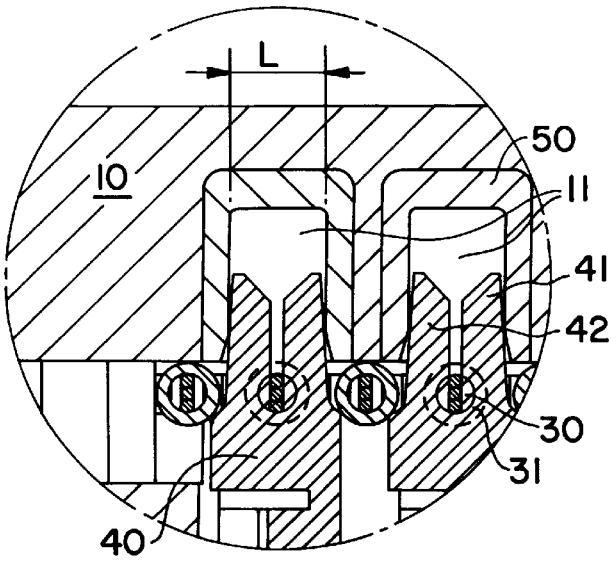
FIG. 6 is a representation of the detail X2 in FIG. 5.

In the cross-sectional views of FIGS. 5 and 6, one row of blades 40 is shown. This row of blades provides connections for every other conductor 30. The intervening conductors 30 are connected to blades in a second row, behind the row illustrated in FIGS. 5 and 6.

Figure 7:
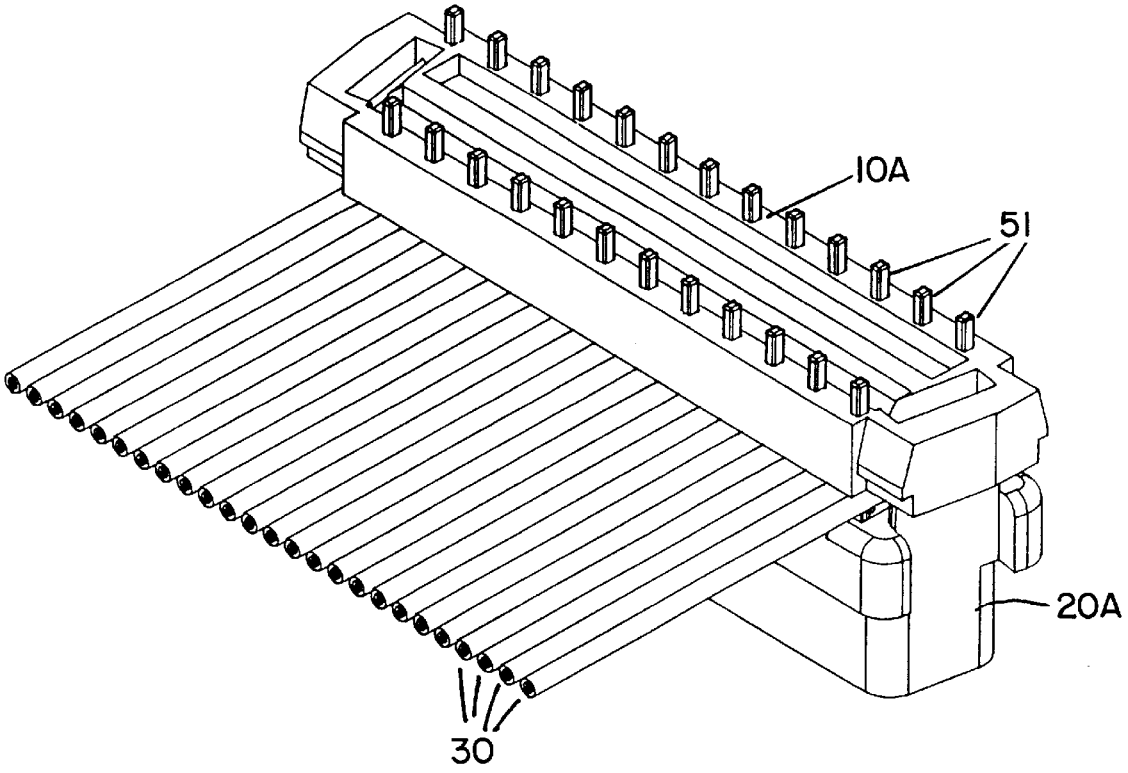
FIG. 7 is a perspective plan view of a variant of the connector in FIG. 1.
Figure 9:
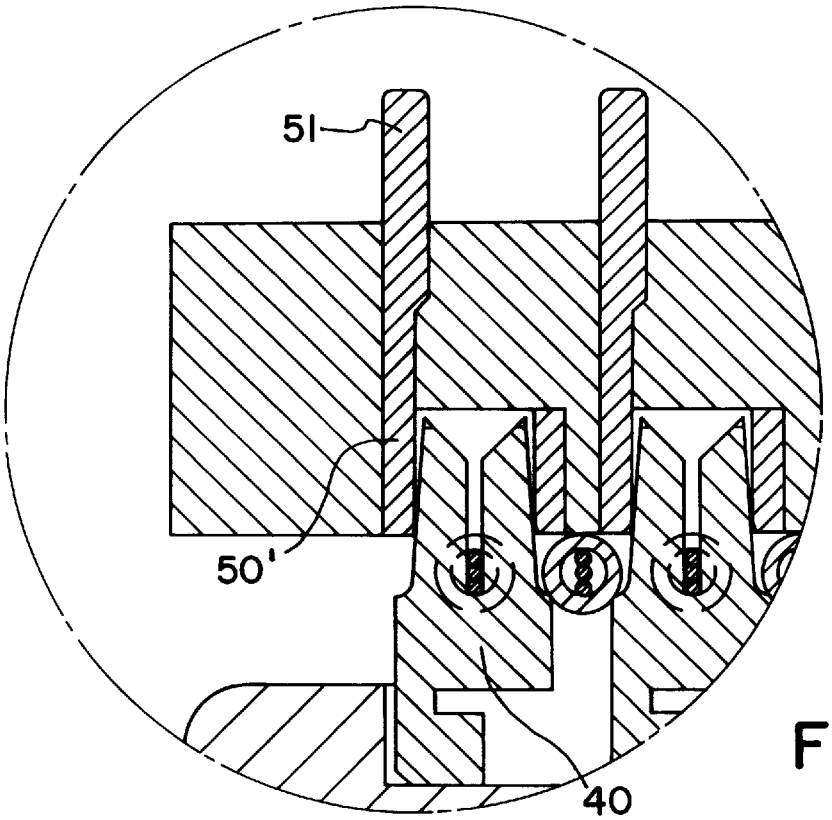
FIG. 9 is a representation of the detail X3 in FIG. 8.
Figure 8:
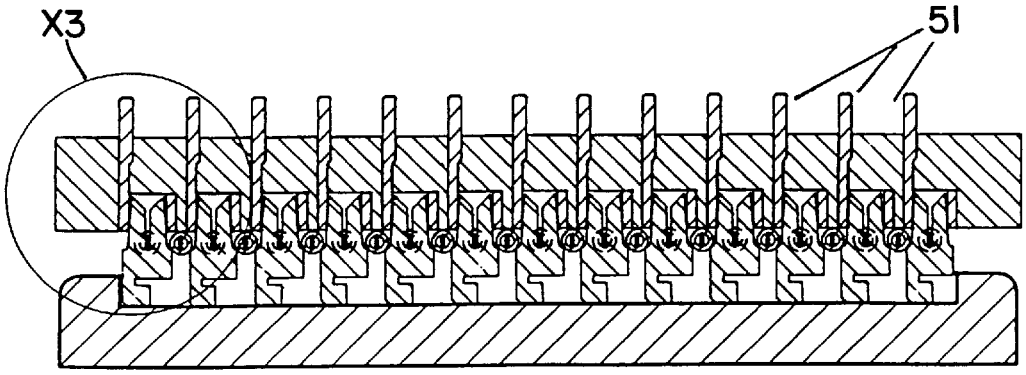
FIG. 8 is a section through the connector in FIG. 7 in the plane of the terminal lugs 51.

The concept of the invention can be advantageously extended, such as is shown by way of example by the second exemplary embodiment of the connector represented in FIGS. 7 to 9.

The connector 7 represented in FIG. 7 differs from the connector represented in FIG. 1 only in that two rows of terminal lugs 51, corresponding to the total number N of conductors 30, project out of the first connector element 10A. In the exemplary embodiment shown in FIG. 7, there is one row containing twelve terminal lugs 51 and one row containing thirteen terminal lugs 51, for connecting to twenty-five conductors 30. Terminal lugs 51 are provided in addition to the contact elements provided in connector element 20A for connection to another connector, as previously described.

Each terminal lug 51 is an integral part of a modified metal housing 50', which is shown in FIG. 9 in particular. Each metal housing 50' is a closed metal housing with an interior cross section of the shape shown by way of example in FIG. 10B, but is open at both its top and bottom ends. Instead, an elongated portion of the lateral wall of each housing 50' is pushed through the plastic material of the first connector element 10A and forms one of the N terminal lugs 51 in its outward oriented portion. Each terminal lug 51 is therefore always at the same potential as the conductor 30 to which it is connected. For example, terminal lugs 51 can be used for testing or control purposes, for example by a connection with corresponding individual contacts at the opposite ends of individually selected conductors 30.

According to a further feature shown in FIG. 4, a protrusion or shaped portion 55 can be provided at the open end of each metal housing 50 facing the associated conductor 30 to cut into, and thus grip, the insulating sheath 31 of the associated conductor. For tension relief, this shaped portion can be embodied in particular as a chamfer which is sloped upwardly in the direction opposite to the direction of tensile stress imposed on conductor 30 when the conductor is subjected to an external force tending to pull it out of the connector. Each housing 50' of the embodiment of FIGS. 7–9 can also be provided with such a shaped portion.

This application relates to subject matter disclosed in German Application number 197 44 754.6, filed on Oct. 10, 1997, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A connector for a cable, the cable having a plurality of insulated conductors enclosed by insulation, each conductor having an end section, said connector comprising:

a first connector element having a plurality of recesses, and a second connector element constructed to be joined to said first connector element to delimit a region for receiving the insulated conductor end sections, with said recesses opening into said region;

a plurality of blade terminals carried by said second connector element and each having two blades, said blade terminals being oriented to extend across said region so that, when said first and second connector elements are joined together said two blades of each of said blade terminals extend into a respective one of said recesses, and a respective conductor end section is gripped between said two blades of a respective one of said blade terminals in order to conductively contact said respective one of said blade terminals;

a plurality of contact elements, each conductively secured to a respective one of said blade terminals, for connection to another connector; and a plurality of inserts each installed in a respective one of said recesses and each constituted by a metal enclosure delimiting an interior space that receives said blades of a respective one of said blade terminals and that is shaped and dimensioned to contact said blades and prevent spreading apart of said blades.

2. The connector in accordance with claim 1, wherein each of said metal enclosures has a shape of a cup.

3. The connector in accordance with claim 1, wherein each of said metal enclosures has a form of a sleeve.

4. The connector in accordance with claim 1, wherein each of said inserts has a terminal lug formed as one piece with said metal enclosure and projecting out of said first connector element in a direction away from said second connector element.

5. The connector in accordance with claim 1, wherein each of said inserts has a projecting portion which projects from said first connector element in a direction toward said second connector element in order to cut into the insulation of a respective one of the insulated conductors when said second connector element is joined to said first connector element and the conductor end sections are located in said region.

6. The connector in accordance with claim 5, wherein each said projecting portion has an inclined surface that is sloped in a direction to provide tensile stress relief for the respective one of the insulated conductors.

* * * * *